US005092391A

United States Patent [19]

Sosin

[11] Patent Number: 5,092,391

[45] Date of Patent: Mar. 3, 1992

[54] DEVICE FOR THE CONTINUOUS CASTING OF THIN METAL PRODUCTS BETWEEN ROLLS

[75] Inventor: Laurent Sosin, Fameck, France

[73] Assignee: Usinor Sacilor, Puteaux, France

[21] Appl. No.: 577,867

[22] Filed: Sep. 5, 1990

[30] Foreign Application Priority Data

Sep. 6, 1989 [FR] France ..... 89 11737

[51] Int. Cl.[5] ..... B22D 11/06

[52] U.S. Cl. ..... 164/428; 164/480

[58] Field of Search ..... 164/428, 480

[56] References Cited

FOREIGN PATENT DOCUMENTS 58-176059 10/1983 Japan .
60-21170 2/1985 Japan .
60-21171 2/1985 Japan .
60-76256 4/1985 Japan .
63-12646 5/1988 Japan .

*Primary Examiner*—Kuang Y. Lin
*Attorney, Agent, or Firm*—Fay, Sharpe, Beall, Fagan, Minnich & McKee

[57] ABSTRACT

The subject of the invention is an installation for the continuous casting of thin metal products between two cooled rotating rolls, of the type comprising a riser, called a "header", interacting with the rolls and the small faces in order to define the casting space, wherein the longitudinal walls of the header in contact with the rolls consist of a refractory with high heat-insulating properties and the front walls of the header in contact with the small faces consist of a refractory material with high mechanical strength.

7 Claims, 1 Drawing Sheet

DEVICE FOR THE CONTINUOUS CASTING OF THIN METAL PRODUCTS BETWEEN ROLLS

MENTION OF GRANT

The invention disclosed herein was made under BRSG Grant #SO7 RRO 5363-27, and the grantee has elected to retain title therein in accordance with 37 C.F.R. §401.14–401.16. The U.S. Government has a paid-up, nonexclusive, nontransferable, irrevocable license in the invention made under said grant and the right in limited circumstances to require the patent owner to license others on reasonable terms as provided for by the terms of the above-identified research grant awarded by the National Institutes of Health.

BACKGROUND OF THE INVENTION

The invention relates to the continuous casting of thin metal products, particularly made from steel, between rolls.

DESCRIPTION OF THE PRIOR ART

In the installations for continuous casting between rolls envisaged hitherto, the molten metal is poured into the casting space defined by the portions of the cylindrical walls of the rolls located above the plane passing through the parallel axes of the said rolls and by the end walls providing the seal, also called small faces or lateral walls. During casting, the molten metal gradually solidifies on contact with the cooled cylindrical walls of the rolls, forming solidified skins which are entrained by the rotating rolls and which join at the level of the neck, that is to say at the level of the said plane passing through the axes of the rolls, in order to form the finished product which is continuously extracted downward.

In certain cases, (see, in particular, documents JP-57-32852 and JP 58-68460), these installations also comprise a kind of fixed riser consisting of two longitudinal walls in sealed contact with the rolls and of two front walls extending the said small faces upwards or forming an integral part of the latter. This riser will hereinafter be denoted by the term "header", by analogy with the part mounted above the ingot mold or the mold and intended to contain the shrinkage header in installations for casting in a fixed ingot mold or for molding. In the case of casting between rolls, this "header" has, in particular, the role of delimiting the roll surface on which the solidification of the cast metal takes place and thus of ensuring the uniformity of this solidification regardless of the level of the metal in the header. Moreover, as the meniscus of the molten metal is no longer in contact with the walls of the rolls, the risk of entrainment of the impurities floating on the meniscus is thus considerably reduced.

This header is proposed in a refractory material with high heat insulating properties which therefore, as is known, are incompatible with a high mechanical strength of the walls of the header. In certain cases, like the use of a spout, for feeding molten metal, which is equipped with lateral outlets directed toward the walls of the header, this mechanical strength may be insufficient in the zones which are under most stress from the flows of molten metal.

SUMMARY OF THE INVENTION

The aim of the invention is to propose a header which is compatible with the use of a lateral-outlet spout and which has satisfactory thermal properties.

To this end, the subject of the invention is an installation for the continuous casting of thin metal products between cooled rotating rolls, of the type comprising a header interacting with the rolls and the small faces in order to define the casting space, characterized in that the longitudinal walls of the header in contact with the rolls consist of a refractory with high insulating properties and in that the front walls of the header in contact with the small faces consist of a refractory with high mechanical strength.

As will be understood, the invention consists in using, for forming the front walls of the header, a refractory which can withstand the mechanical stresses undergone due to the jets of metal issuing from the spout, it being possible for this refractory to be less insulating than that forming the longitudinal walls of the header.

The casting space which is delimited by the rolls, the small faces and the header is fed by a spout which is immersed in the pool of molten metal and connected to a tundish placed above the machine and containing the molten metal to be cast. In the simplest case, this spout is straight and has a single opening at its end. The metal thus penetrates into the molten pool according to a vertical direction up to a depth which can vary as a function of the geometrical characteristics of the machine and of the hydrodynamic parameters of its feed. The main drawback of such a device is that the molten metal, shortly after emerging from the spout, risks flowing over the rolls on which the solidified skin is being formed. Upon contact with the hot metal coming directly from the tundish, the solidified skin partially remelts, which gives rise to considerable risks of rupture of this skin at the level of the space between the axes of the rolls and below.

This problem can be solved by the combined use of a header and of a spout equipped with at least one opening oriented laterally so that the metal penetrating into the casting space reaches the rolls only after having circulated in the molten pool and lost most of its excess heat and of its kinetic energy. One example of such a spout consists in a spout with two openings oriented in opposite directions on one and the same horizontal axis or on two substantially horizontal axes and emerging inside the header, that is to say above the zone where the metal solidifies on the rolls. In such a device, the flows of metal emerging from the spout firstly strike the walls of the header. These must thus have sufficient mechanical strength.

Usually, all the walls of the header are produced in a material which has good insulating properties, such as silica foam with a density of 0.5 or 0.75 g/cm$^3$ or an aluminous fibrous refractory. In fact, it is essential for the refractories in contact with the rolls to be as insulating as possible as they tend to cool by conduction in the zone where this contact takes place. If this cooling is too great, the result may be the formation, at this point, of a layer of solidified metal which gradually increases. Due to this phenomenon, constancy of the supply conditions of the molten metal on the rolls is no longer suitably ensured. Moreover, this solidified layer may become detached periodically, giving rise to the formation of defects on the product.

In point of fact, as has been stated, the mechanical strength of these materials is inversely proportional to their insulating capacity. If the walls of the header undergo the impact of a flow of molten metal emerging from one of the horizontal openings of the spout, there is a considerable risk of damage to these walls.

According to the invention, in order to form the front walls of the header interacting with the small aces of the machine, use is made of a dense refractory with greater mechanical strength. In fact, the inventors consider that the insulating properties of these front walls have only a relatively small importance. By using a compact refractory, such as silica, or an aluminous concrete, the use of the header is made compatible with that of a spout equipped with two lateral outlets if these outlets direct the jets of metal towards the resistant front walls.

DESCRIPTION OF THE DRAWINGS

The invention will be better understood in the light of the following description which is given with reference to the appended single plate of drawings, in which:

In FIG. 1, the rolls 1, 1' of a machine for the continuous casting of thin metal products are mounted beneath a header 2 which is composed of four walls. The longitudinal walls 3, 3' are in contact with the rolls and are oriented according to a direction which is substantially parallel to the axis of the rolls. They are made from a refractory material with high insulating properties. The front walls 4, 4' are placed in a leak-tight manner on the small faces (not visible in FIG. 1) which laterally close off the casting space 5 delimited by the rolls. The play between the walls of the header must be as small as possible, (preferably less than 1/10 mm) in order to avoid infiltrations of molten metal. The spout 6, supplying the machine with molten metal and connected to a tundish which is not shown, is equipped with two lateral openings each facing one of the front walls 4, 4' of the header and orienting the flows of metal preferably onto these walls 4, 4', as indicated by the arrows.

FIG. 2 shows the vertical arrangement of the elements of the machine. It shows the pool 8 of molten metal, the meniscus 9 of which is located inside the header 2 and, therefore, above the rolls 1, 1'. The molten metal solidifies against the walls of the rolls 1, 1' which are rotating in opposite directions and gives rise to a solid product 10. The header 2 is in contact, on the one hand, with the rolls 1, 1' by means of its longitudinal walls 3, 3' in insulating refractory and, on the other hand, with the small lateral faces closing off the casting space (of which only one 11 is visible in FIG. 2) by means of its front walls 4, 4' in resistant refractory. The spout 6 is immersed in the molten pool 8 and its openings 7, 7' emerge inside the header 2, that is to say above the upper edges 12 of the small faces 11 and of the lower edges 13, 13' of the longitudinal walls of the header.

Figure 2:
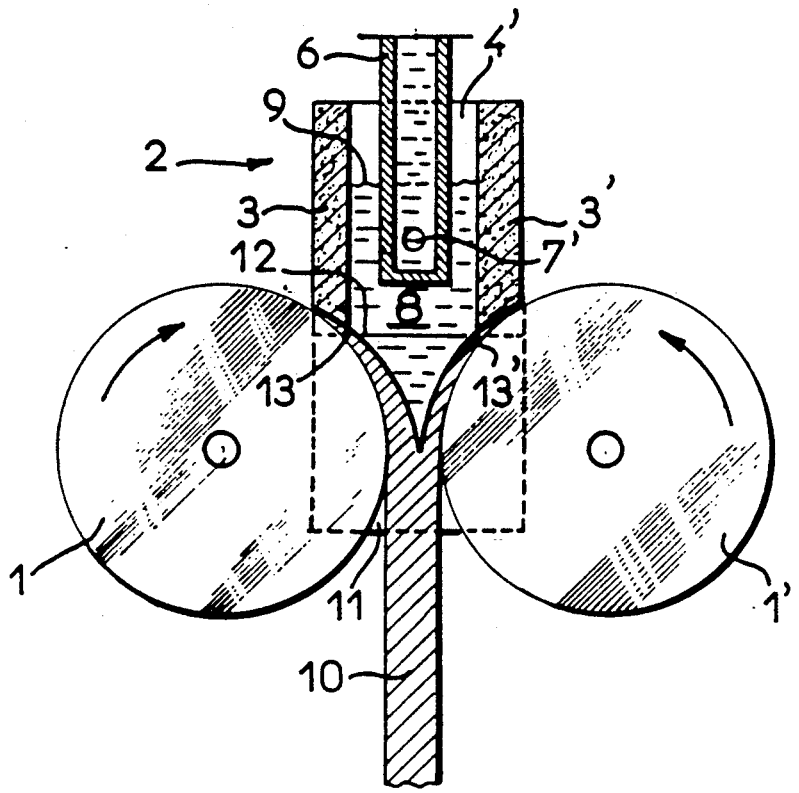
FIG. 2 is a section through the axis A—A in FIG. 1.
Figure 1:
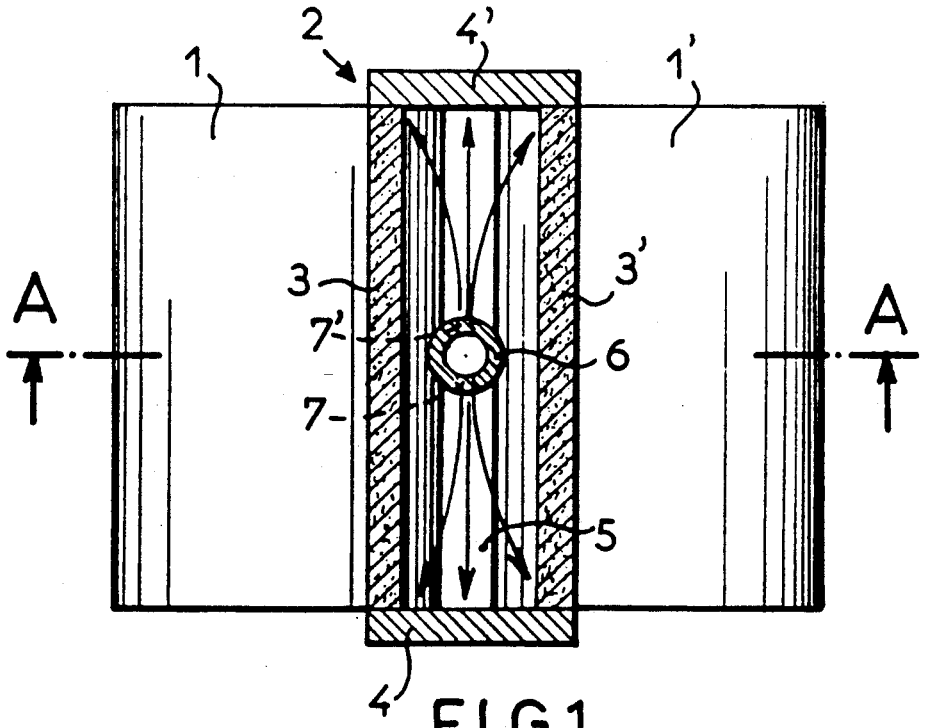
FIG. 1 shows diagrammatically, seen from above, the rolls, the spout and the header of an installation for the continuous casting of thin metal products according to the invention.

The essential characteristics to be taken into account for the choice of materials for the header are:

for the longitudinal walls, the thermal conductivity which, measured at 1,000° C., must be less than 0.5 W/m.K.

for the front walls, the apparent density, which must be greater than 1.5 kg/dm$^3$.

Of course, the invention is not limited to the example described and shown. In particular, the front walls of the header may not be placed on the small faces but may be integral parts thereof. Moreover, the spout may have a form and a number of openings other than those in the example, the essential point being that it does not orient a high-speed flow of the metal towards the insulating longitudinal walls of the header. Finally, the method may be applied to headers of variable dimensions used on machines whose rolls may be displaced according to their axes in order to vary the width of the product cast.

I claim:

1. An installation for the continuous casting of thin metal products between two cooled rotating rolls, of the type comprising a header interacting with the rolls and the small faces in order to define the casting space, wherein the longitudinal walls of the header in contact with the rolls comprise a refractory material with high heat-insulating properties and the front walls of the header in contact with the small faces comprise a refractory material having a higher mechanical strength than a mechanical strength of the refractory material comprising the longitudinal walls of the header.

2. The installation as claimed in claim 1, which comprises a spout, for feeding molten metal, which is equipped with two lateral outlets each oriented towards the front walls of the header.

3. The installation as claimed in claim 1, wherein the refractory material forming the longitudinal walls of the header has a thermal conductivity of less than 0.5 W/m.K at 1,000° C.

4. The installation as claimed in claim 1 wherein the refractory material forming the front walls of the header has an apparent density greater than 1.5 kg/dm$^3$.

5. The installation as claimed in claim 4 wherein the refractory material forming the longitudinal walls of the header has an apparent density that is between 0.5 to 0.75 g/cm$^3$.

6. The installation as claimed in claim 4 wherein the refractory material forming the front walls of the header comprises silica.

7. The installation as claimed in claim 4 wherein the refractory material forming the front walls of the header comprises an aluminous concrete.

* * * * *